US006148557A

United States Patent [19]

Lindskog et al.

[11] Patent Number: 6,148,557

[45] Date of Patent: Nov. 21, 2000

[54] ARRANGEMENT RELATING TO A WEAPON WITH A BARREL, SUCH AS A RIFLE

[75] Inventors: Kjell Lindskog, Skellefteå; Ola Friström, Umeå, both of Sweden

[73] Assignee: SQS Security Qube System AB, Skelleftea, Sweden

[21] Appl. No.: 09/227,426

[22] Filed: Jan. 8, 1999

Related U.S. Application Data

[63] Continuation-in-part of application No. PCT/SE97/01236, Jul. 6, 1997.

[30] Foreign Application Priority Data

Jul. 10, 1996 [SE] Sweden ..... 9602731

[51] Int. Cl.[7] ..... F41A 17/44

[52] U.S. Cl. ..... 42/70.01

[58] Field of Search ..... 42/90, 70.01; 89/1.11; 102/430

[56] References Cited

U.S. PATENT DOCUMENTS

| | | | |
|---|---|---|---|
| 3,060,855 | 10/1962 | Henning et al. | 102/430 |
| 3,973,498 | 8/1976 | Persson | 102/305 |
| 4,442,619 | 4/1984 | McCarley | 42/90 |
| 4,681,038 | 7/1987 | Washburn | 102/430 |
| 5,309,842 | 5/1994 | Matysik et al. | 102/430 |

FOREIGN PATENT DOCUMENTS

| | | | |
|---|---|---|---|
| 41209 | 2/1910 | Australia | 102/430 |
| 2635581 | 2/1990 | France . | |
| 503762 | 8/1996 | Sweden . | |
| 9206345 | 4/1992 | WIPO . | |

*Primary Examiner*—Stephen M. Johnson
*Attorney, Agent, or Firm*—Nils H. Ljungman & Associates

[57] ABSTRACT

A device and a method for rendering useless a weapon, such as a rifle, that includes a barrel, in the event of the weapon being taken or manipulated unlawfully. The device includes a rod having a cavity or bore. The rod is adapted for insertion into the barrel of the weapon, and an explosive charge is placed in the cavity of the rod. When an alarm is triggered, the explosive agent is activated and the rod and the barrel are deformed.

7 Claims, 3 Drawing Sheets

ARRANGEMENT RELATING TO A WEAPON WITH A BARREL, SUCH AS A RIFLE

CONTINUING APPLICATION DATA

This application is a Continuation-In-Part application of International Patent Application No. PCT/SE97/01236, filed on Jul. 6, 1997, which claims priority from Swedish Patent Application No. 9602731.3, filed on Jul. 10, 1996. International Application No. PCT/SE97/01236 was pending as of the filing date of the above-cited application. The United States was an elected state in International Application No. PCT/SE97/01236.

BACKGROUND OF THE INVENTION

Field of the Invention

The present invention relates to a device and to a method for rendering a weapon, such as a rifle, that includes a barrel, useless if misappropiated or manipulated unlawfully.

OBJECT OF THE INVENTION

One object of the present invention is to provide a device for destroying a weapon, such as a rifle, in conjunction with its misappropriation and unlawful manipulation. This object can be achieved in a device which includes a rod that has a cavity or bore. The rod can be adapted for insertion into the barrel of a weapon. The cavity or bore in the rod can accomodate an explosive charge.

Another object of the present invention is to provide a method for destroying a weapon, such as a rifle, in conjunction with its misappropriation and unlawful manipulation. This object can be achieved by using a device which functions to render the weapon useless with the aid of an explosive charge or the like in conjunction with an alarm being triggered.

These objects can also be realized according to the features described hereinbelow.

SUMMARY OF THE INVENTION

Because the present invention will result in such damage to a weapon that is misappropriated and used unlawfully as to make it extremely difficult and troublesome to repair the weapon, the present invention is a highly effective theft deterrent.

The present invention can be combined with many different types of alarm devices that generate an alarm signal which causes activation of the explosive substance and therewith destruction of the weapon.

The present invention has both technical and economical advantages.

BRIEF DESCRIPTION OF THE DRAWINGS

The present invention will now be described in more detail with reference to an exemplifying embodiment thereof and also with reference to the accompanying drawing, in which.

DESCRIPTION OF THE PREFERRED EMBODIMENT

Figure 1:
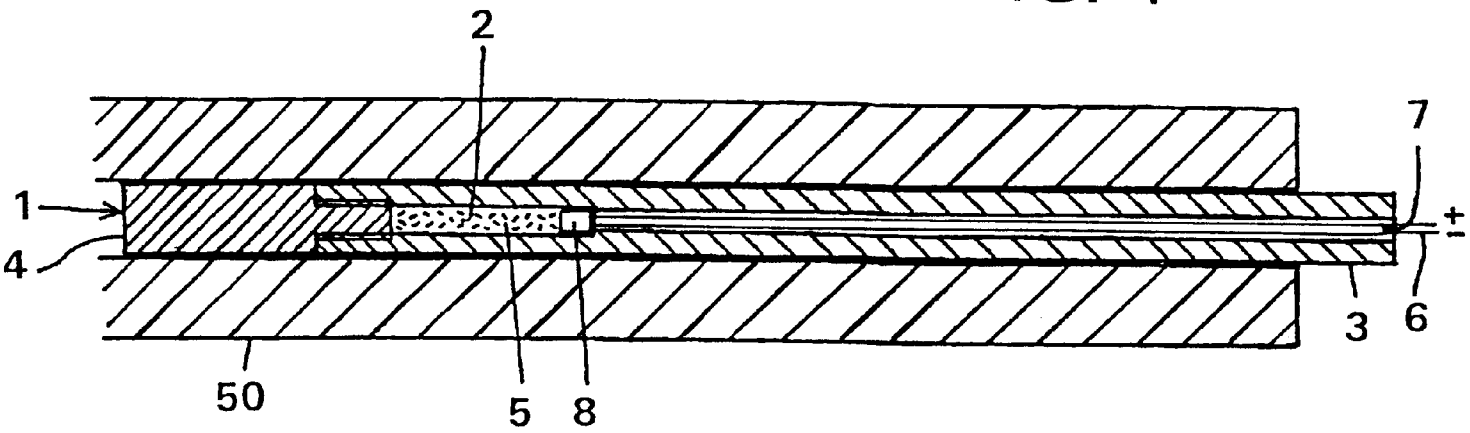
FIG. 1 illustrates schematically a barrel of a weapon provided with an inventive device.

The device 1 in accordance with the present invention includes a metal rod 3 that has a cavity or bore 2. The rod 3 has a shape and size which enables the rod to be inserted in, and fitted in, a barrel 50 of the weapon concerned, as shown in FIG. 1. One end of the cavity 2 is restricted or blocked by a plug 4. The cavity 2 can be filled with an explosive substance 5, such as pentyl. An electric ignition wire 6 is extended to an electric igniter 8 in contact with the explosive substance 5, as shown in FIG. 1. A hole or bore 7 is provided for accomodation of the ignition wire 6.

Figure 2:
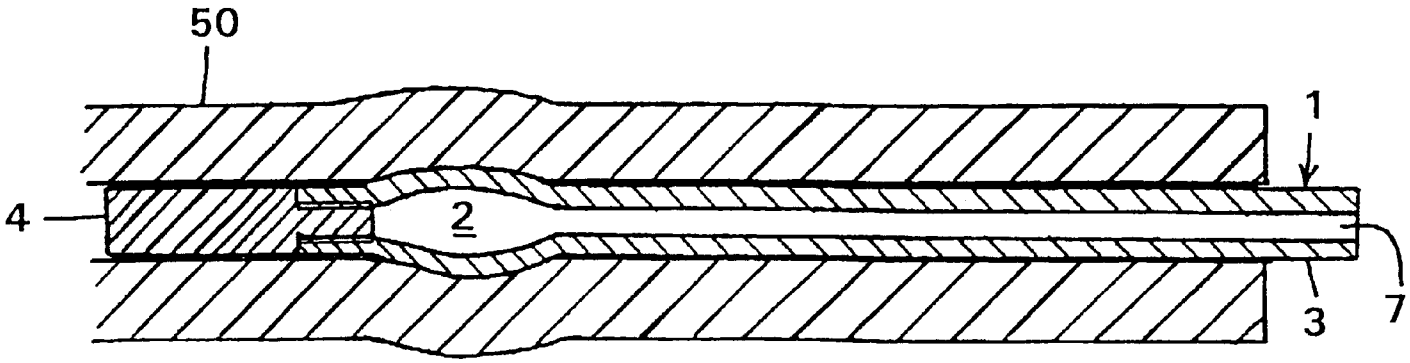
FIG. 2 illustrates the device and the barrel subsequent to activation of the device.

The device 1 functions in the following way. The ignition wire 6 forms part of, or is connected to, an alarm circuit (see FIG. 3) of suitable design. When the alarm is triggered as a result of attempting to steal the weapon for instance, current can be supplied to the ignition wire 6 and thus to the igniter 8, such as to explode the explosive substance 5. The explosive power of said substance 5 is sufficient to partially expand and therewith deform the rod 3 and the barrel 50, as illustrated in FIG. 2. The present invention thus functions to seriously damage the weapon when activated. The explosion can also cause the rod 3 to fuse or weld to the barrel 50, so as to render removal of the rod practically impossible.

Figure 3:
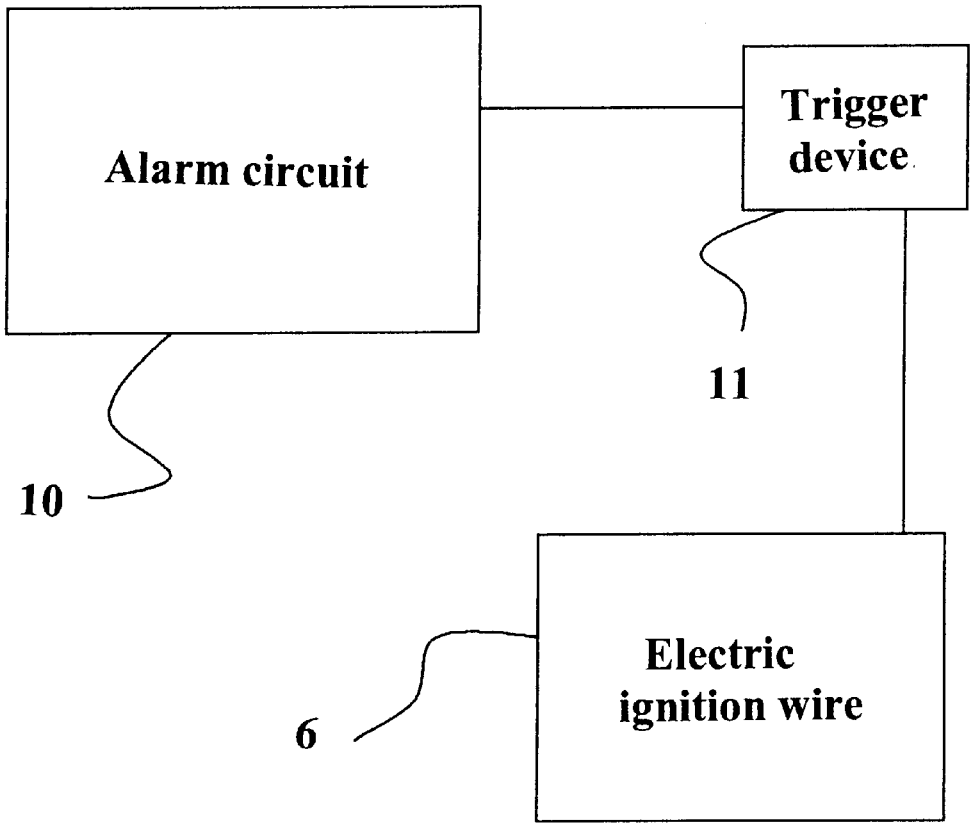
FIG. 3 is a diagram of a connection of an alarm system to the device in accordance with one possible embodiment of the present invention.

FIG. 3 shows a diagram according to one possible embodiment of the present invention with an alarm circuit or device or system 10 that can be operatively connected to the ignition wire 6. A trigger or tripping device 11 can form the connection between the alarm circuit or device or system 10 and the ignition wire 6. This connection can permit the alarm device 10 to activate the ignition wire 6 to explode the explosive substance 5 when the trigger or tripping device 11 is triggered by a person attempting to steal or unlawfully use the weapon.

It will be understood that the structural components of the inventive device 1 can vary widely within the scope of the invention. For instance, the cavity 2 may be replaced with one or more recesses or apertures of some other type and shape.

The explosive substance may also be replaced with alternative explosive means and the hole or bore 7 may be plugged to enhance the effect of the explosion.

Figure 4:
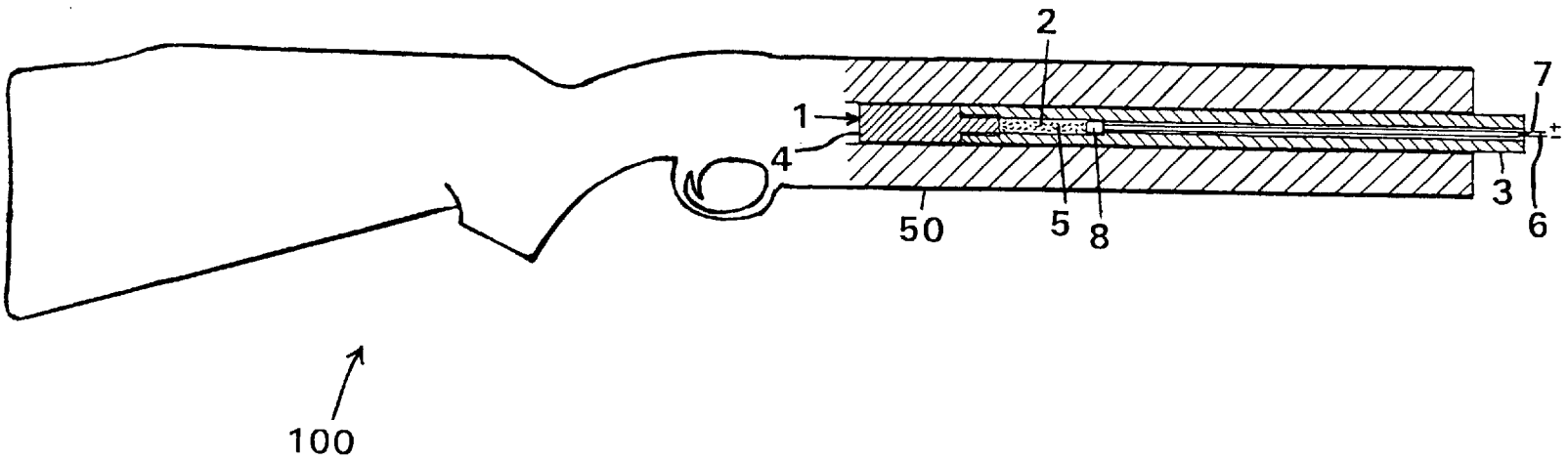
FIG. 4 shows schematically one possible embodiment a weapon, such as a rifle, provided with an inventive device.

FIG. 4 shows schematically one possible embodiment of a weapon 100, such as a rifle, with which the present invention can be utilized.

The present invention is therefore not restricted to the illustrated and described embodiment, since changes and modifications are conceivable within the scope of the following claims and features.

One feature of the invention resides broadly in the device for rendering useless a weapon that includes a barrel, when the weapon is taken or manipulated unlawfully, characterized in that the device 1 includes a rod 3 that has a cavity or bore 2; in that the rod 3 is adapted for insertion into the barrel 50 of the weapon; and in that the cavity 2 or bore in said rod accomodates an explosive charge 5.

Another feature of the invention resides broadly in the device characterized in that the wall of the rod 3 is relatively thin in the region in which the explosive charge 5 is placed, so as to enable radial deformation of the rod 3 and the barrel 50.

Yet another feature of the invention resides broadly in the device characterized in that the explosive charge is pentyl or some like explosive substance.

Still another feature of the invention resides broadly in the method of rendering useless a weapon that includes a barrel, when the weapon is taken or manipulated unlawfully, characterized by using a device 1 which functions to render the weapon useless with the aid of an explosive charge 5 or the like in conjunction with an alarm being triggered.

A further feature of the invention resides broadly in the method characterized in that both the device 1 and the barrel 50 of the weapon are deformed in response to an alarm being triggered.

Another feature of the invention resides broadly in the method characterized in that at least a part of the device 1 is placed in the barrel 50 of the weapon.

Some examples of security systems or locking devices to prevent unauthorized use of a firearm which could possibly be utilized or adapted for use in one embodiment of the present invention can be found in the following U.S. Pat. Nos. 5,664,358, issued on Sep. 9, 1997 to inventors Haber, et al.; No. 5,548,915, issued on Aug. 27, 1996 to inventors Szarmach, et al.; No. 5,487,234, issued on Jan. 30, 1996 to inventor Dragon; No. 5,459,957, issued on Oct. 24, 1995 to inventor Winer; No. 5,450,685, issued on Sep. 19, 1995 to inventor Peterson; No. 5,171,924, issued on Dec. 15, 1992 to inventors Honey, et al.; No. 5,016,377, issued on May 21, 1991 to inventor Gunning; No. 4,672,763, issued on Jun. 16, 1987 to inventor Cunningham; and No. 4,018,339, issued on Apr. 19, 1977 to inventor Pritz.

Some examples of alarms, alarm devices, or alarm circuits which could possibly be utilized or adapted for use in one embodiment of the present invention can be found in the following U.S. Pat. Nos. 5,831,531, issued on Nov. 3, 1998 to inventor Tuttle; No. 5,775,235, issued on Jul. 7, 1998 to inventors Lindskog, et al.; No. 5,686,909, issued on Nov. 11, 1997 to inventor Steinhauser; No. 5,554,833, issued on Sep. 10, 1996 to inventor Johnson; No. 5,548,915, issued on Aug. 27, 1996 to inventors Szarmach, et al.; No. 5,191,314, issued on Mar. 2, 1993 to inventors Ackerman, et al.; No. 4,300, 130, issued on Nov. 10, 1981 to inventors Fotheringham, et al.; and No. 3,967,239, issued on Jun. 29, 1976 to inventor Steele.

Some examples of explosive devices or explosive substances which could possibly be utilized or adapted for use in one embodiment of the present invention can be found in the following U.S. Pat. Nos. 5,775,235, issued on Jul. 7, 1998 to inventors Lindskog, et al.; No. 5,600,086, issued on Feb. 4, 1997 to inventor Lemmonier; No. 5,505,631, issued on Apr. 9, 1996 to inventors Schauer, et al.; No. 5,503,077, issued on Apr. 2, 1996 to inventor Motley; No. 5,485,788, issued on Jan. 23, 1996 to inventor Corney; and No. 5,035, 843, issued on Jul. 30, 1991 to inventor Schmid.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Swedish Patent Application No. 9602731.3, filed on Jul. 10, 1996, having inventors Kjell Lindskog and Ola Fristrom, and Laid-open Swedish Patent Application No. 9602731.3, if any, and Published Swedish Patent Application No. 9602731.3, if any, and International Application No. PCT/SE97/01236, filed on Jul. 6, 1997, and WO/98/01716, as well as their published equivalents, and other equivalents or corresponding applications, if any, in corresponding cases in Sweden and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A weapon in combination with an anti-theft device for rendering useless said weapon upon said weapon being one of stolen or manipulated unlawfully, said weapon comprising:

a barrel;

a firing mechanism to fire a projectile from said weapon;

said firing mechanism being configured and disposed to be activated by a user to fire said weapon; and said anti-theft device comprising:

a rod;

said rod being configured to be inserted into and disposed in said barrel along a length of said barrel;

an explosive charge being configured to produce an explosion to deform said barrel;

said rod comprising a portion to receive said explosive charge;

said explosive charge being disposed at said portion;

an ignition device;

an alarm circuit being configured to sense upon said weapon being one of stolen or manipulated unlawfully and to generate a signal to explode said explosive charge;

said ignition device being configured and disposed to operatively connect said explosive charge and said alarm circuit that senses upon said weapon being one of stolen or manipulated unlawfully;

said alarm circuit being configured to activate said ignition device upon said alarm circuit sensing upon said weapon being one of stolen or manipulated unlawfully; and said ignition device being configured to ignite said explosive charge to produce an explosion to deform said barrel upon activation of said ignition device.

2. The weapon according to claim 1, wherein:

a section of said rod is configured and disposed to extend out of the barrel; and said alarm circuit is disposed on said section of said rod that extends out of said barrel.

3. The weapon according to claim 2, wherein:

said rod comprises side walls; and said side walls are substantially thin to permit deformation of said rod and said barrel by the explosion produced by said explosive charge.

4. The weapon according to claim 3, wherein said explosive charge is pentyl.

5. A method for rendering a weapon substantially useless, said weapon being in combination with an anti-theft device for rendering useless said weapon upon said weapon being one of stolen or manipulated unlawfully, said weapon comprising: a barrel; a firing mechanism to fire a projectile from said weapon; said firing mechanism being configured and disposed to be activated by a user to fire said weapon; and said anti-theft device comprising: a rod; said rod being configured to be inserted into and disposed in said barrel along a length of said barrel; an explosive charge being configured to produce an explosion to deform said barrel; said rod comprising a portion to receive said explosive charge; said explosive charge being disposed at said portion; an ignition device; an alarm circuit being configured to sense upon said weapon being one of stolen or manipulated unlawfully and to generate a signal to explode said explosive charge; said ignition device being configured and disposed to operatively connect said explosive charge and said alarm circuit that senses upon said weapon being one of stolen or manipulated unlawfully; said alarm circuit being configured to activate said ignition device upon said alarm circuit sensing upon said weapon-being one of stolen or manipulated unlawfully; and said ignition device being configured to ignite said explosive charge to produce an explosion to deform said barrel upon activation of said ignition device; said method comprising the steps of:

activating said alarm circuit of said anti-theft device upon said alarm circuit sensing said weapon being one of stolen or manipulated unlawfully;

activating said ignition device upon the activation of said alarm circuit;

igniting said explosive charge upon the activation of said ignition device;

producing an explosion upon the ignition of said explosive charge; and deforming said barrel with said explosion.

6. The method according to claim 5, wherein said step of deforming said barrel with said explosion further comprises deforming both said rod and said barrel with said explosion.

7. The method according to claim 6, wherein said anti-theft device further comprises:

a first portion;

a second portion;

said first portion is disposed in said barrel; and said second portion is configured and disposed to extend from said barrel.

* * * * *